US010370936B2

(12) United States Patent
Patel

(10) Patent No.: US 10,370,936 B2
(45) Date of Patent: Aug. 6, 2019

(54) CHEMICAL INJECTION VALVE SYSTEM

(71) Applicant: Schlumberger Technology Corporation, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 399 days.

(21) Appl. No.: 15/082,899

(22) Filed: Mar. 28, 2016

(65) Prior Publication Data

US 2016/0281463 A1 Sep. 29, 2016

Related U.S. Application Data

(60) Provisional application No. 62/138,731, filed on Mar. 26, 2015.

(51) Int. Cl.
*E21B 34/10* (2006.01)
*E21B 43/25* (2006.01)

(52) U.S. Cl.
CPC ..... *E21B 34/102* (2013.01); *E21B 34/101* (2013.01); *E21B 34/107* (2013.01); *E21B 43/25* (2013.01)

(58) Field of Classification Search
CPC ..... E21B 34/08; E21B 34/10; E21B 34/16; E21B 34/102; E21B 34/107; E21B 34/101; E21B 43/25; E21B 43/16; E21B 43/166; E21B 21/103
USPC ..... 166/307, 304
See application file for complete search history.

(56) References Cited

U.S. PATENT DOCUMENTS

| | | | | |
|---|---|---|---|---|
| 2,634,689 A * | 4/1953 | Walton | E21B 43/123 417/112 |
| 4,523,602 A * | 6/1985 | Snyder | E21B 34/16 137/458 |
| 2002/0066574 A1* | 6/2002 | Leismer | E21B 34/066 166/375 |
| 2009/0008078 A1* | 1/2009 | Patel | E21B 34/10 166/50 |
| 2010/0101788 A1* | 4/2010 | Mennem | E21B 43/25 166/268 |
| 2013/0048303 A1* | 2/2013 | Patel | E21B 34/10 166/373 |

* cited by examiner

*Primary Examiner* — Brad Harcourt
*Assistant Examiner* — David Carroll

(57) ABSTRACT

A technique facilitates controlled injection of a chemical injection fluid at a desired downhole location. A chemical injection valve is mounted along a well tubing and is disposed externally of an internal flow passage through the well tubing. The chemical injection valve is operated via hydraulic pressure which is applied to actuate the chemical injection valve between closed flow and open flow positions. The chemical injection valve controls flow of the chemical injection fluid to at least one injection port. The at least one injection port may be positioned to inject the chemical injection fluid into the internal flow passage of the well tubing.

15 Claims, 13 Drawing Sheets

CHEMICAL INJECTION VALVE SYSTEM

CROSS-REFERENCE TO RELATED APPLICATION

The present document is based on and claims priority to U.S. Provisional Application Ser. No. 62/138,731 filed Mar. 26, 2015, which is incorporated herein by reference in its entirety.

BACKGROUND

In many hydrocarbon well applications, well servicing may involve the injection of chemicals downhole. For example, chemicals may be injected to facilitate flow of production fluids into the well, to facilitate testing applications, and/or to enhance operation of downhole equipment. Chemical injection fluids are formulated with the desired chemicals according to the treatment application. The chemical injection fluids are then pumped downhole through a chemical injection line for injection at the desired downhole location.

SUMMARY

In general, a system and methodology facilitate controlled injection of a chemical injection fluid at a desired downhole location. A chemical injection valve is mounted along a well tubing and is disposed externally of an internal flow passage through the well tubing. The chemical injection valve is operated via hydraulic pressure which is applied to actuate the chemical injection valve between closed flow and open flow positions. The chemical injection valve controls flow of the chemical injection fluid to at least one injection port. In some embodiments, the at least one injection port is positioned to inject the chemical injection fluid into the internal flow passage of the well tubing.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate controlled injection of a chemical injection fluid. In well applications, the system enables controlled injection at a desired downhole location. For example, a chemical injection valve may be mounted along a well tubing proximate a desired injection zone, e.g. proximate specific well equipment and/or proximate a desired location along the wellbore. The chemical injection valve may be disposed externally of an internal flow passage through the well tubing to, for example, maximize flow area along the internal flow passage for production of well fluids.

The chemical injection valve may be operated via hydraulic pressure which is selectively applied to actuate the chemical injection valve between closed flow and open flow positions. When in an open flow position, the chemical injection valve enables flow of the chemical injection fluid to at least one injection port. In some embodiments, the at least one injection port is positioned to inject the chemical injection fluid into the internal flow passage of the well tubing. Additionally, the open flow position may be adjustable to enable control over the amount of chemical injection fluid flow.

Figure 1:
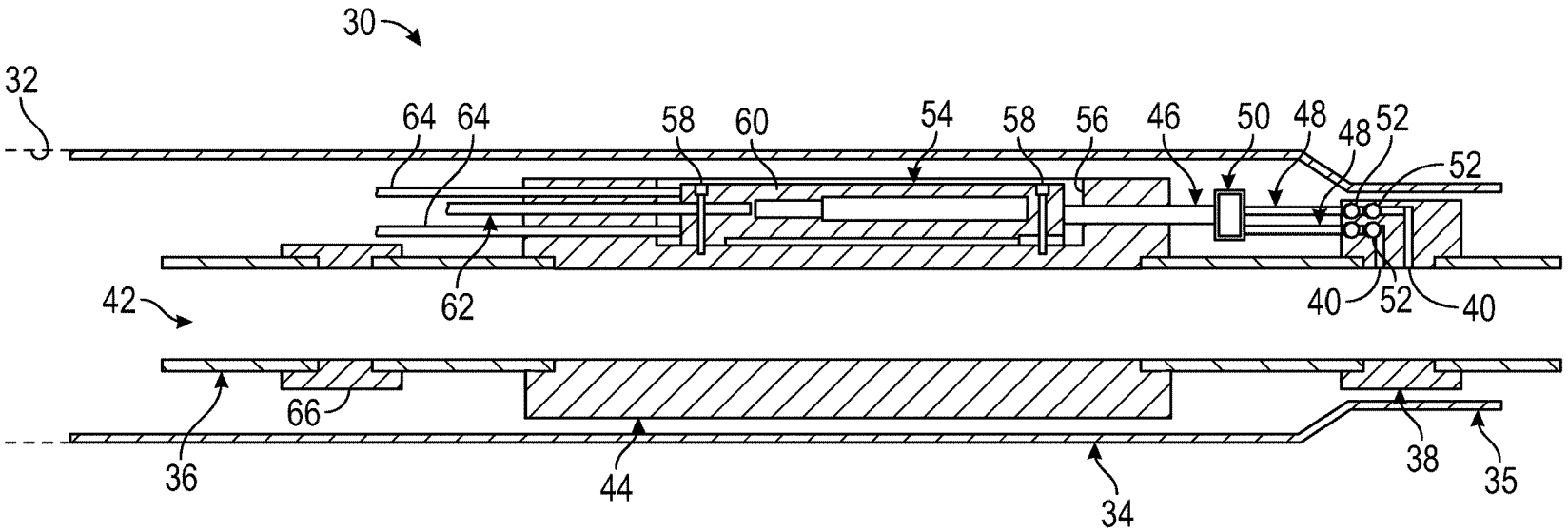
FIG. 1 is a schematic illustration of a well system positioned in a borehole and comprising an example of a chemical injection valve, according to an embodiment of the disclosure.

Referring generally to FIG. 1, an example of a well system 30 is illustrated as deployed in a borehole 32, e.g. a wellbore. In this example, the borehole 32 is cased with a well casing 34 which may include a reduced diameter section 35, such as a section formed by a liner. However, the well system 30 may be utilized in open hole wellbores without casing. The well system 30 may comprise a tubing 36, e.g. well tubing, disposed in the well casing 34. Additionally, a chemical injection mandrel 38 may be mounted along well tubing 36 and may comprise at least one chemical injection port 40, e.g. a plurality of chemical injection ports. In this example, the at least one chemical injection port 40 is positioned to direct a chemical injection fluid into an internal flow passage 42 disposed along the interior of well tubing 36. The internal flow passage 42 may be used to direct production fluids or other fluids along the interior of well tubing 36 and various other well system components.

As illustrated, the well system 30 may further comprise a chemical injection valve mandrel 44 mounted along the well tubing 36. The chemical injection valve mandrel 44 may be coupled in fluid communication with chemical injection mandrel 38 and the at least one chemical injection port 40 via a chemical injection outlet line 46. In some embodiments, the chemical injection outlet line 46 may comprise a plurality of chemical injection lines 48 to which the injection fluid is distributed via a hydraulic distribution block 50. A check valve 52 (or a plurality of check valves 52) may be positioned along each chemical injection line 48. By way of example, the check valves 52 may be located in chemical injection mandrel 38 upstream of injection ports 40.

A chemical injection valve 54 is mounted to chemical injection valve mandrel 44, e.g. mounted in an internal region 56 of chemical injection valve mandrel 44. The chemical injection valve 54 may be communicatively coupled with chemical injection outlet line 46 and may be secured to chemical injection valve mandrel 44 via a suitable attachment mechanism 58, e.g. threaded fasteners. For example, the attachment mechanism 58 may be used to secure a hydraulic block 60 of chemical injection valve 54 to the chemical injection valve mandrel 44. A chemical injection inlet line 62 is coupled with chemical injection valve 54 to supply the chemical injection fluid to chemical injection valve 44 and, ultimately, to the at least one chemical injection port 40. The chemical injection valve 54 may be selectively actuated to different operational positions, e.g. closed flow and open flow positions, at least in part by pressure inputs supplied via pressure control lines 64. It should be noted that in some applications, the tubing 36 may be formed as a well tubing string having joints or sections of tubing connected together by tubing connectors 66.

Figure 2:
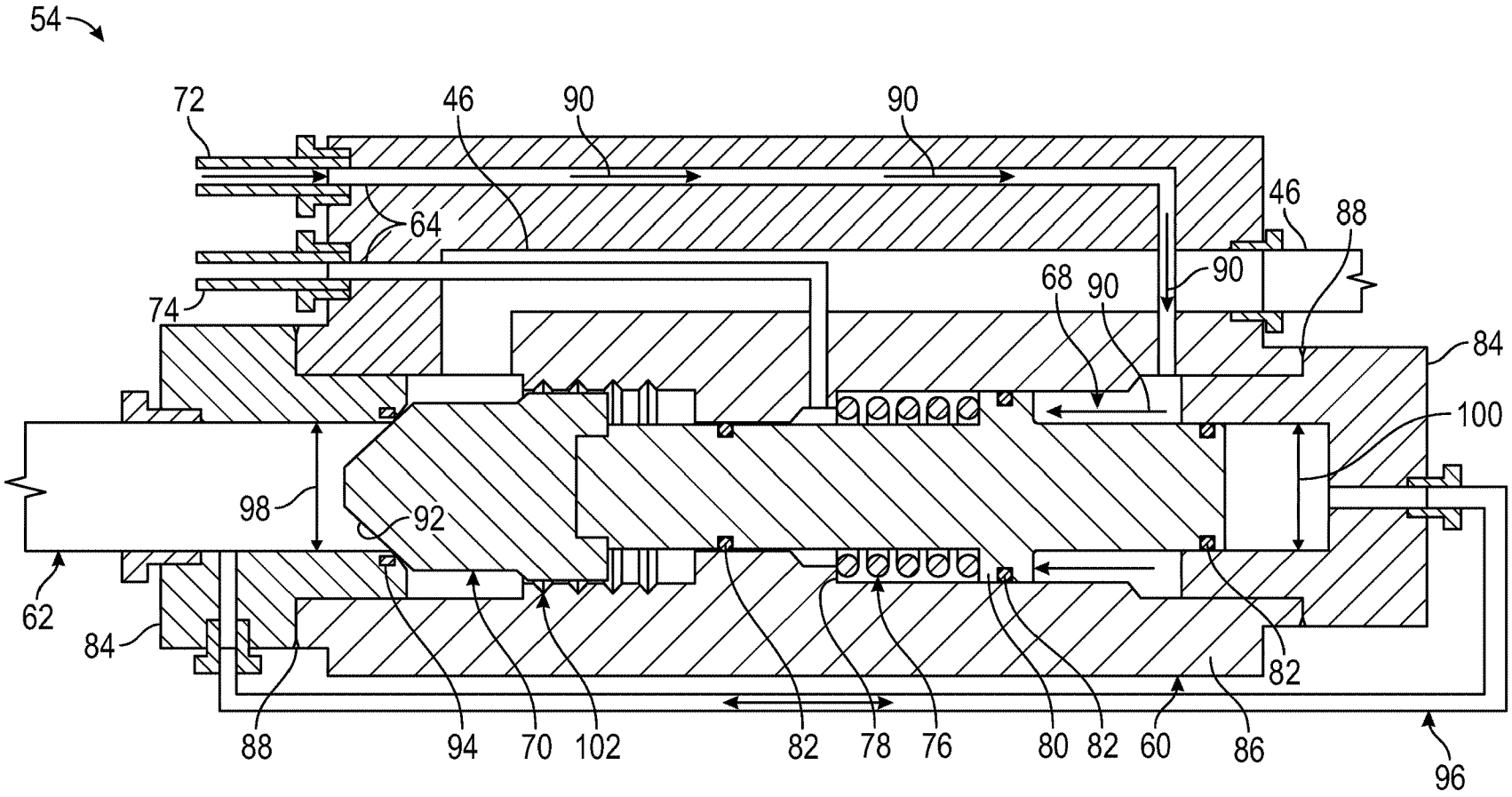
FIG. 2 is a schematic illustration of an example of a chemical injection valve, according to an embodiment of the disclosure.

Referring generally to FIG. 2, an embodiment of chemical injection valve 54 is illustrated. In this embodiment, the chemical injection valve 54 comprises a power piston 68 coupled with a seal member 70. The power piston may be manipulated via pressure inputs supplied through pressure control lines 64 to enable shifting of the seal member 70 between closed and open flow positions with respect to flow of chemical injection fluid through the valve 54 and ultimately to the at least one injection port 40.

Figure 3:
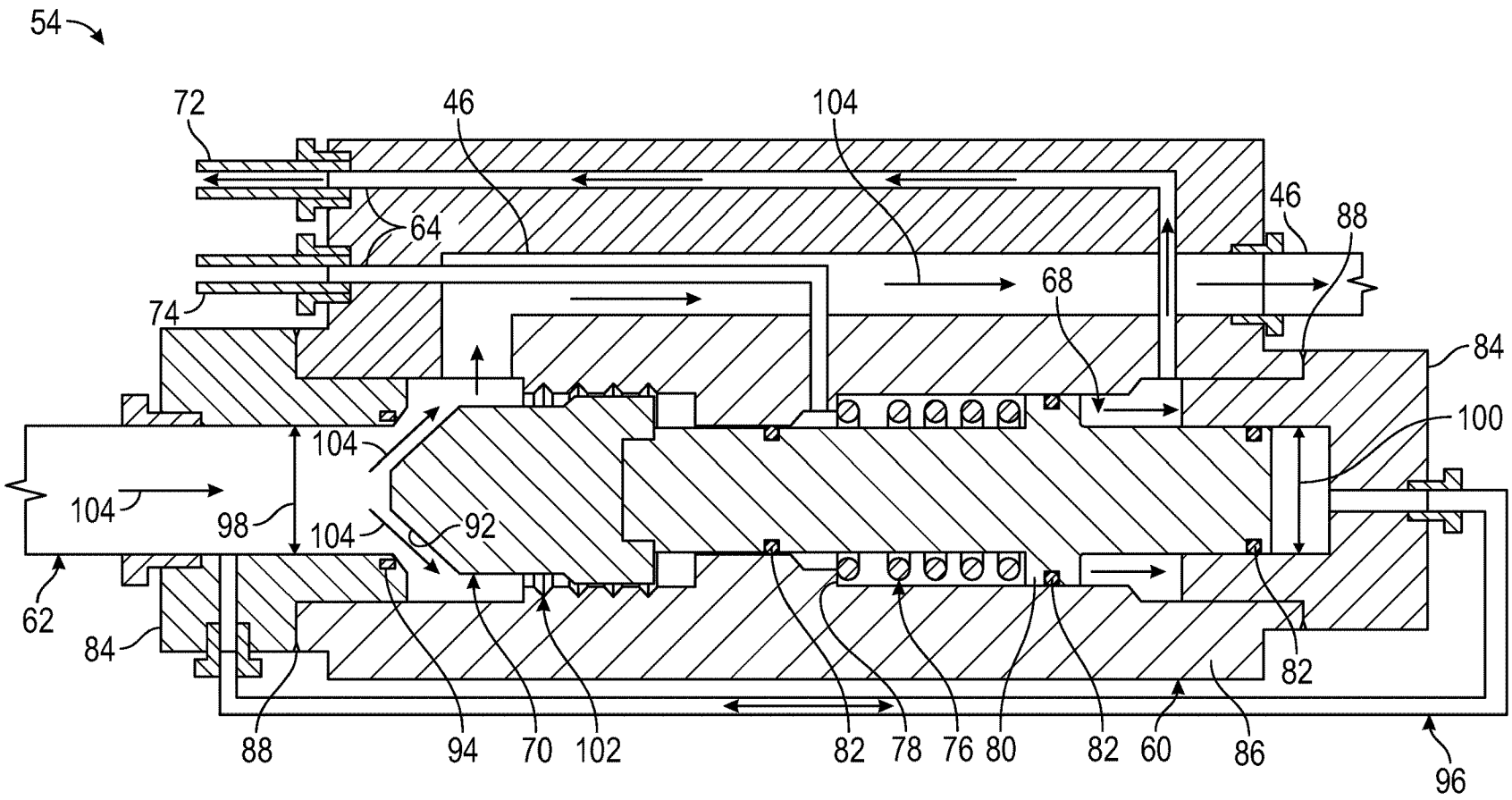
FIG. 3 is a schematic illustration similar to that of FIG. 2 but showing the chemical injection valve in a different operational position, according to an embodiment of the disclosure.

In the embodiment illustrated, the pressure control lines 64 comprise a pressure close line 72 and a pressure open line 74. By way of example, the pressure close line 72 and pressure open line 74 both may be routed uphole to a pressure source at the surface. Furthermore, the pressure close line 72 is routed through hydraulic block 60 to one side of power piston 68, and the pressure open line 74 is routed to an opposite side of power piston 68 is illustrated. In this example, the power piston 68 is spring biased in a direction toward shifting the seal member 70 to an open flow position, as illustrated in FIG. 3. The spring biasing may be achieved by a spring member 76, such as a coiled spring disposed about power piston 68. In the example illustrated, the spring member 76 is captured between an internal abutment 78 of hydraulic block 60 and a radially expanded portion 80 of power piston 68.

The power piston 68 may be slidably and sealably engaged with the interior of hydraulic block 60 via a plurality of seals 82, such as O-ring seals. In some embodiments, the hydraulic block 60 may comprise block ends 84 secured to a main block portion 86 by a suitable fastening mechanism 88, e.g. a weldment, threaded engagement, and/or other suitable fastener.

To maintain the chemical injection valve 54 in the closed flow position, as illustrated in FIG. 2, sufficient pressure is maintained along the pressure close line 72 as represented by arrows 90. The applied pressure 90 moves power piston 68 against the bias of spring member 76 and forces seal member 70 into sealing engagement with hydraulic block 60. By way of example, seal member 70 may comprise a seal surface 92 oriented for sealing engagement with a corresponding seal 94 located in a portion of hydraulic block 60, e.g. in one of the hydraulic block ends 88.

In some embodiments, the chemical injection valve 54 further comprises a pressure equalization line 96 extending to opposite sides of power piston 68. By way of example, the pressure equalization line 96 may extend between a passage 98 on one side of seal member 70 and a passage 100 on an opposite side of power piston 68. In this example, the passages 98, 100 have equal diameters and surface areas. Depending on the application, a plurality of detents 102 or other holding features may be positioned along seal member 70 or along other suitable components to provide a desired level of resistance to movement of the seal member 70 when the seal member 70 is at specific seal member flow positions.

When chemical injection valve 54 is to be shifted to the open position illustrated in FIG. 3, the pressure in close line 72 may be bled off to allow spring member 76 to shift power piston 68 and seal member 70 to the open flow position. Depending on the operation, the actuation of chemical injection valve 54 to the open flow position may be supplemented via pressure applied through open line 74 and/or chemical injection inlet line 62. For example, a failsafe open may be achieved by combining the biasing force of spring member 76 with pressure applied through chemical injection inlet line 62 to force power piston 68 and seal member 70 to the open flow position.

Once valve 54 is shifted to the open flow position, a flow of injection fluid, as represented by arrows 104, moves past seal member 70 and through chemical injection outlet line 46. The detents 102 may be used to establish different levels of flow when chemical injection valve 54 is transitioned to the open flow position.

Figure 4:
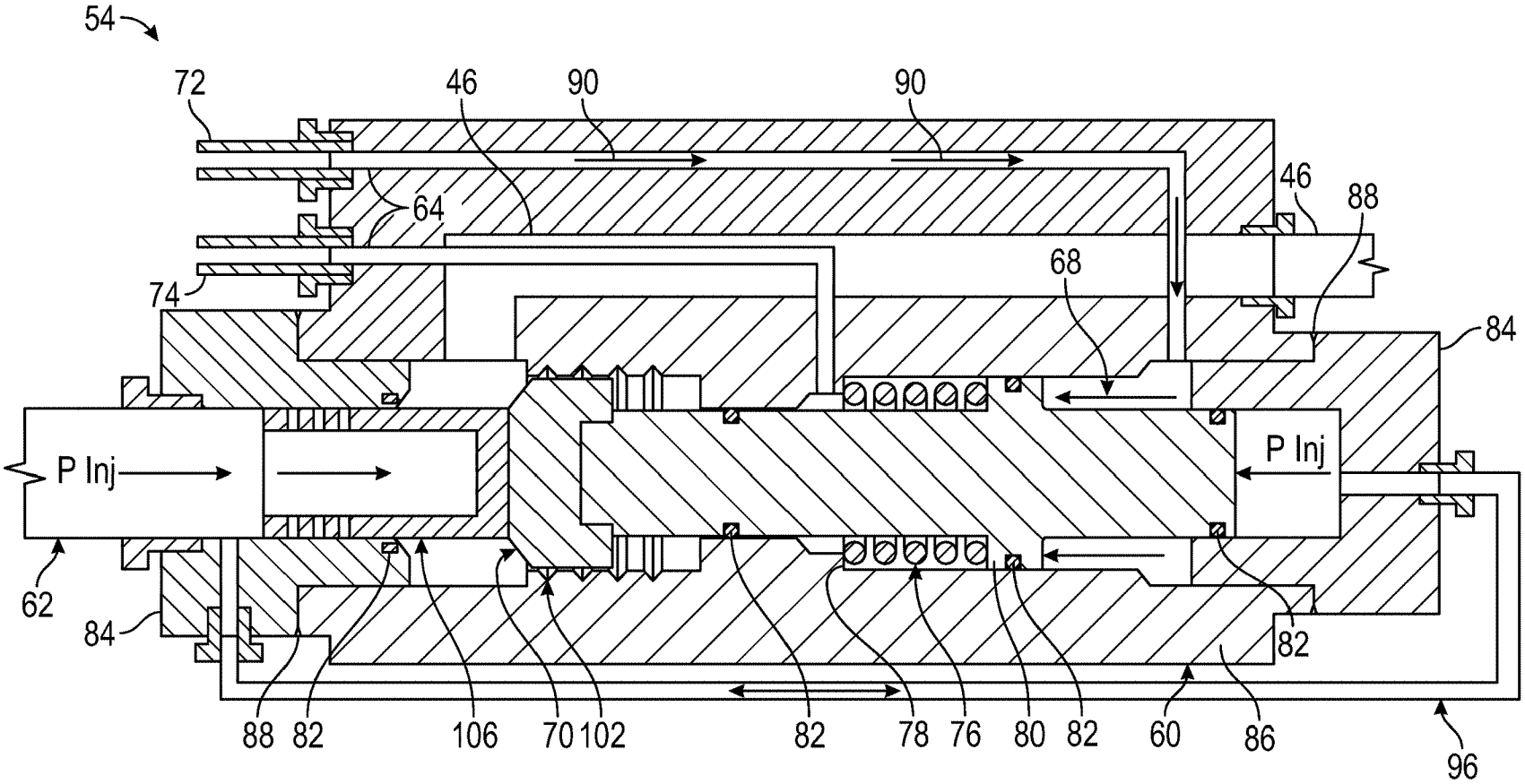
FIG. 4 is a schematic illustration of another example of the chemical injection valve, according to an embodiment of the disclosure.
Figure 5:
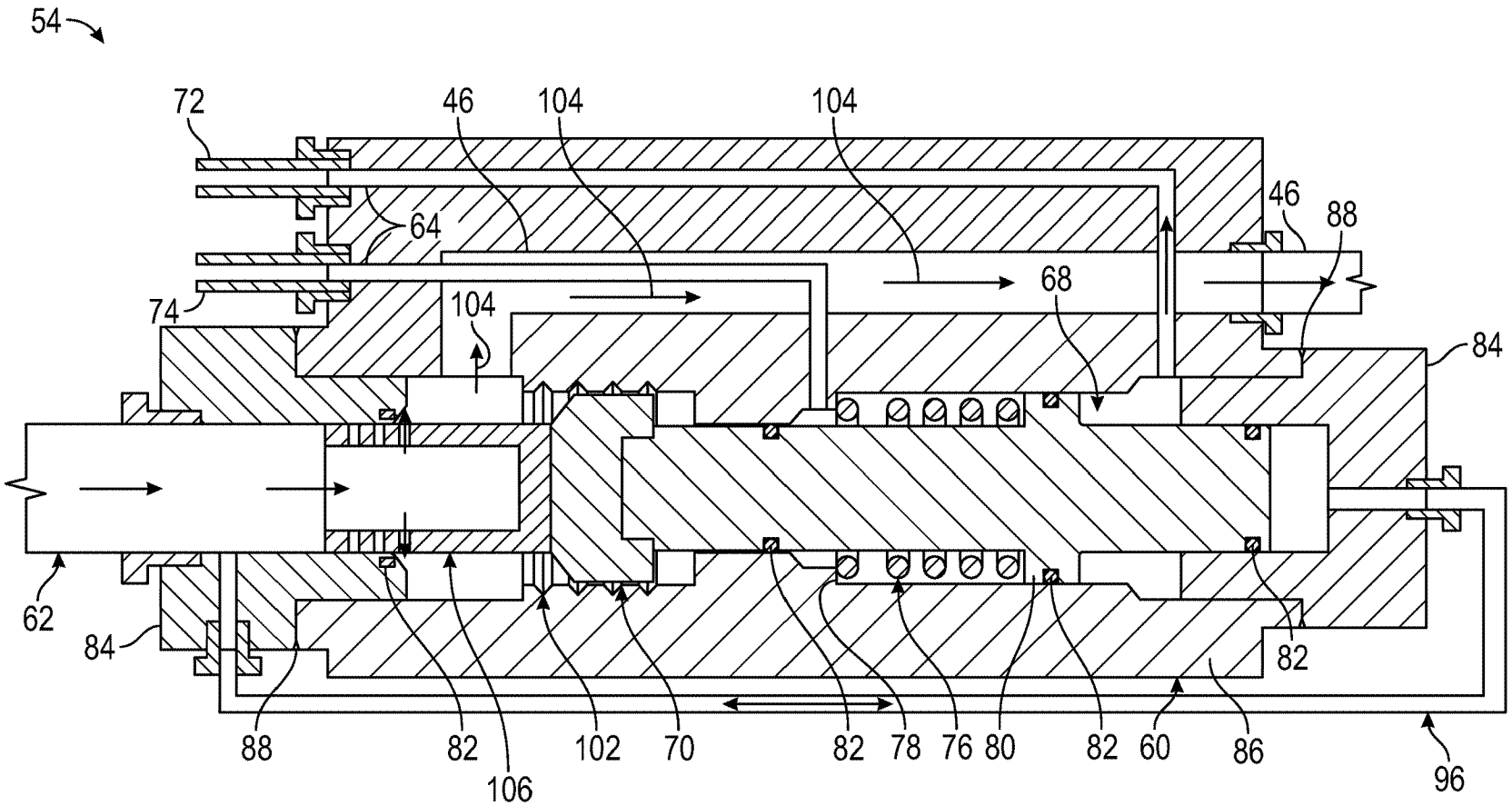
FIG. 5 is a schematic illustration similar to that of FIG. 4 but showing the chemical injection valve in a different operational position, according to an embodiment of the disclosure.

Referring generally to FIG. 4, another embodiment of chemical injection valve 54 is illustrated. In this embodiment, a choke 106 is used to facilitate control over the amount of flow, e.g. volume flow rate, through valve 54 when valve 54 is shifted to an open position. By way of example, the choke 106 may be in the form of a discrete or continuous choke having discrete or continuous choke positions corresponding with different levels of fluid flow. In some embodiments, the choke 106 may be used in combination with detents 102 to establish the different flow level positions, as illustrated in FIG. 5. Another seal 82 may be used to form a slidable seal between choke 106 and a surrounding internal surface of hydraulic block 60.

Figure 6:
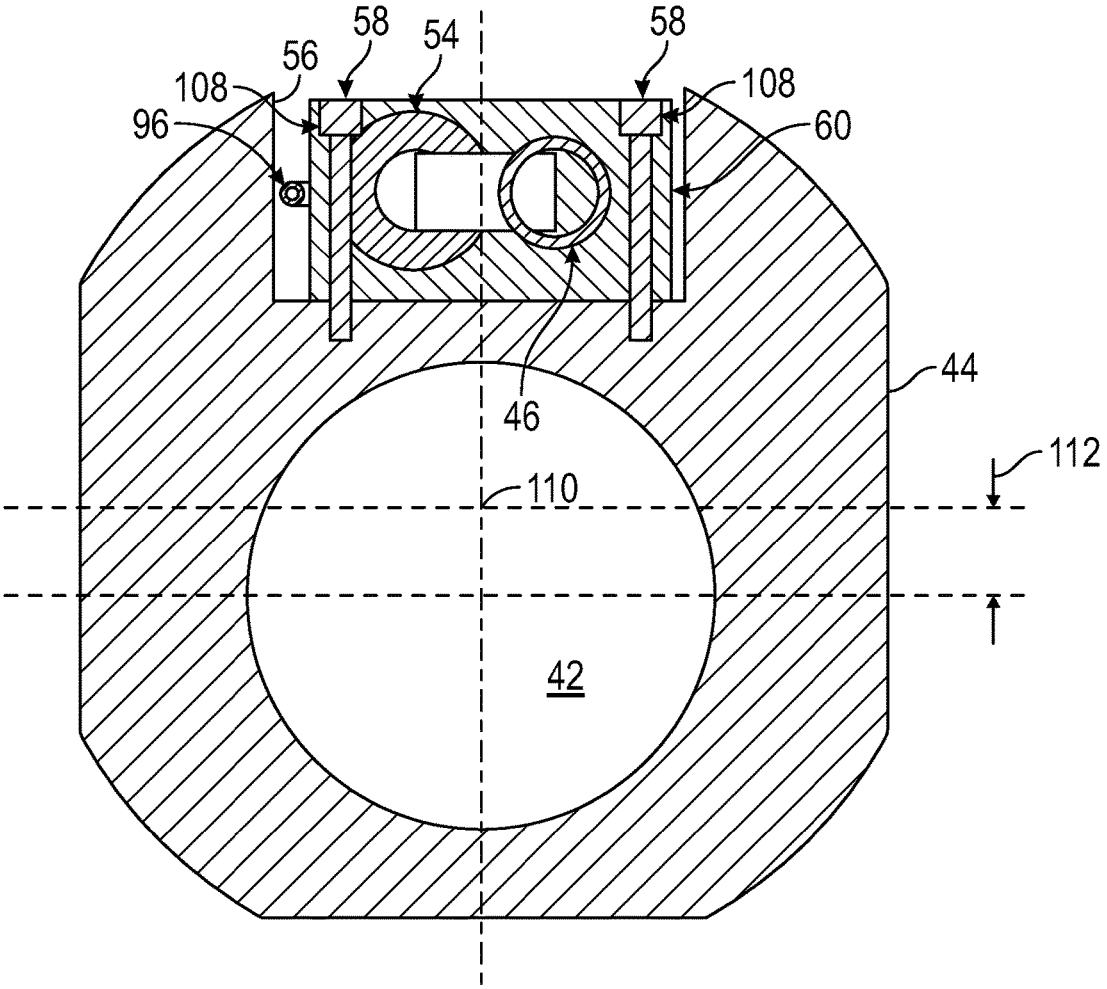
FIG. 6 is a cross-sectional view of an example of the chemical injection valve mounted in a chemical injection valve mandrel, according to an embodiment of the disclosure.

In FIG. 6, an embodiment of chemical injection valve 54 is illustrated in cross-section as mounted along chemical injection valve mandrel 44. By way of example, the chemical injection valve 54 may be one of the types described above with reference to FIGS. 2-5. In this example, the attachment mechanisms 58 comprise threaded bolts 108 which extend through hydraulic block 60 for threaded engagement with chemical injection valve mandrel 44. By way of example, the chemical injection valve 54 may be positioned within internal region 56 which is constructed in the form of a recess formed in an outer surface of mandrel 44. The main internal flow passage 42 may be offset from a center 110 of mandrel 44 by a desired eccentricity 112 to provide sufficient space for internal region 56 and chemical injection valve 54.

Figure 7:
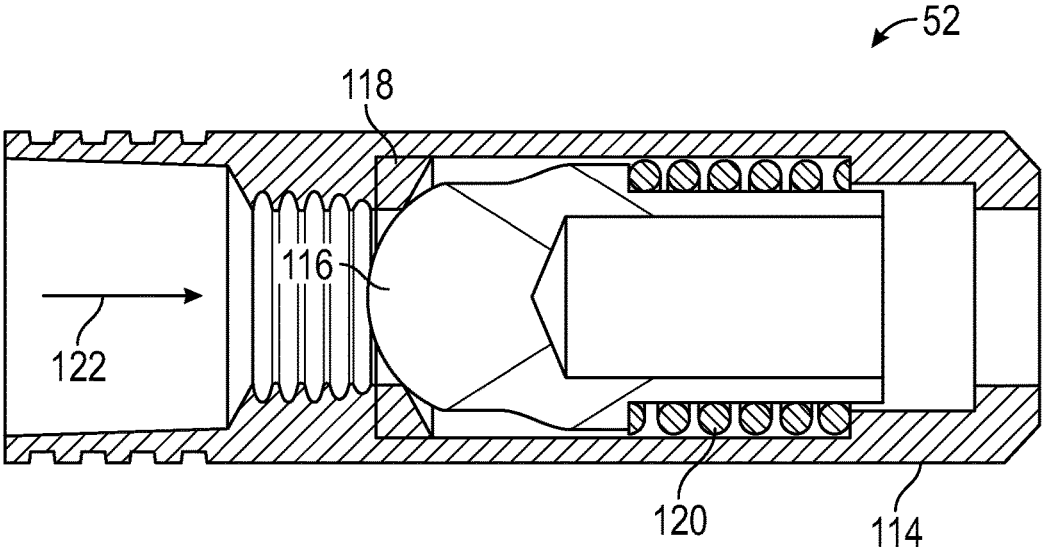
FIG. 7 is a cross-sectional view of an example of a check valve which may be located along a pathway of chemical injection flow, according to an embodiment of the disclosure.

As discussed above, check valves 52 may be utilized in chemical injection mandrel 38 to enable flow of chemical injection fluid from chemical injection valve 54 into internal flow passage 42. The check valves 52, however, are oriented to prevent backflow of fluid from the internal flow passage 42 into chemical injection valve 54. By way of example, each check valve 52 may comprise an outer housing 114 sized for sealing engagement with a corresponding receptacle formed in chemical injection mandrel 38 as illustrated in FIG. 7. Within housing 114, a valve element 116 is spring biased into sealing engagement with a corresponding seal element 118. The spring bias may be provided by a spring member 120, such as a coil spring. Thus, the check valve 52 readily allows fluid flow in the direction of arrow 122 while preventing flow in an opposite direction.

Figure 8:
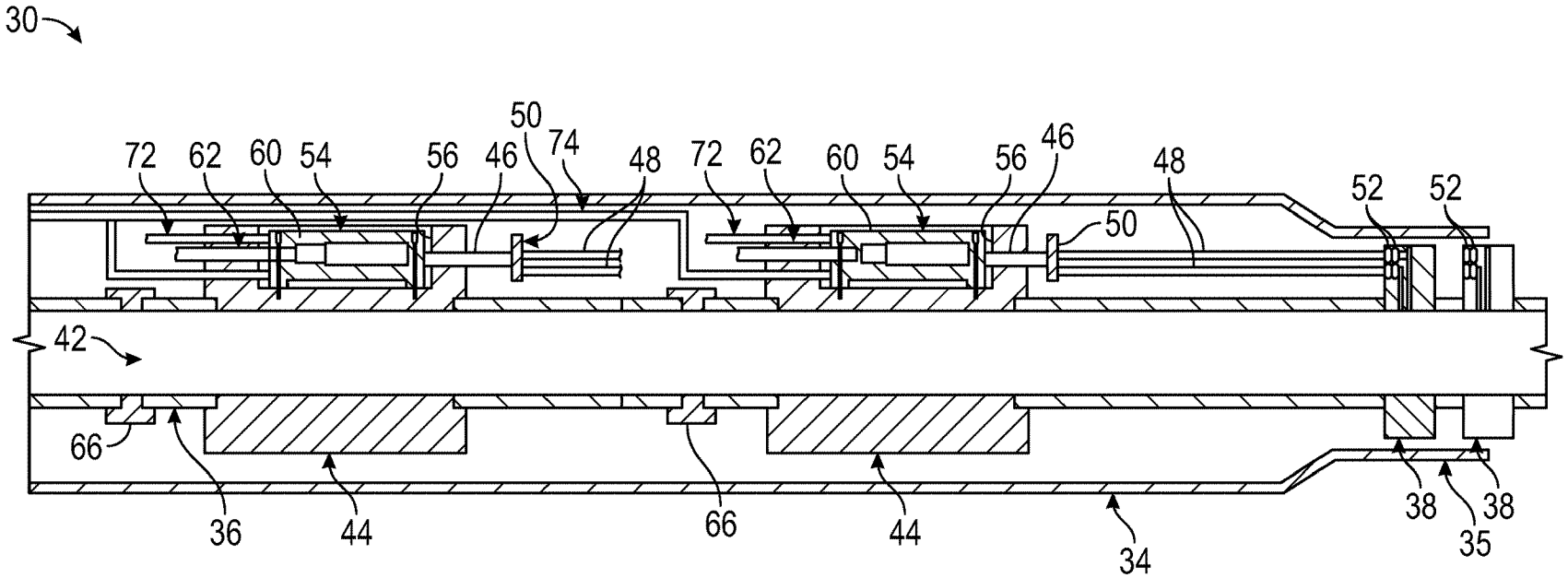
FIG. 8 is a schematic illustration of another example of a well system positioned in a borehole and comprising a plurality of chemical injection valves, according to an embodiment of the disclosure.

Referring generally to FIG. 8, another embodiment of a well system 30 is illustrated. In this example, well system 30 comprises a plurality of the chemical injection valve mandrels 44 with each mandrel 44 having a corresponding chemical injection valve 54. For example, a first chemical injection valve mandrel 44, with corresponding chemical injection valve 54, may be located at a first position along well tubing 36; and a second or additional chemical injection valve mandrel 44, with second corresponding chemical injection valve 54, may be located at a second position along well tubing 36. In some applications, a common pressure open line 74 may be used for the chemical injection valves 54. As illustrated, each chemical injection valve 54 may be connected to its own chemical injection mandrel 38 and port(s) 40.

Figure 9:
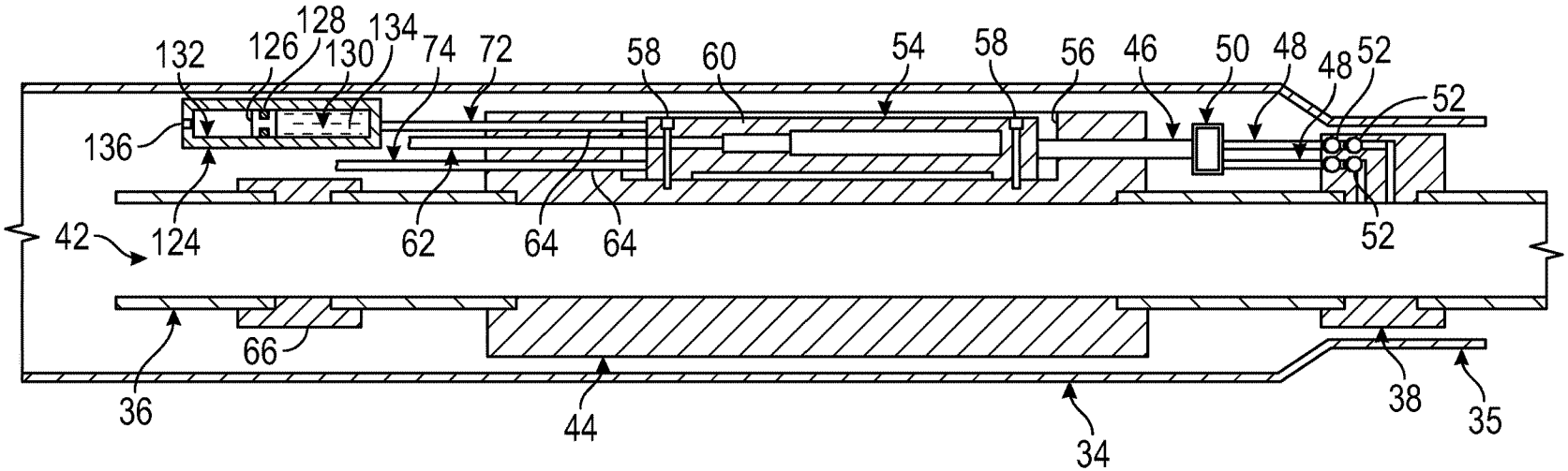
FIG. 9 is a schematic illustration of another example of a well system positioned in a borehole and comprising a chemical injection valve, according to an embodiment of the disclosure.

Referring generally to FIG. 9, another embodiment of well system 30 is illustrated. This embodiment is similar to the embodiment illustrated and described with respect to FIG. 1. However, the pressure close line 72 is referenced to an annulus pressure rather than being routed to the surface. In some embodiments, the pressure close line 72 may be coupled with an annulus pressure chamber 124 disposed in the annulus between tubing 36 and casing 34.

According to an embodiment of annulus pressure chamber 124, a piston 126 having a seal 128 is slidably and sealably engaged with an inner surface of pressure chamber 124. The piston 126 divides the pressure chamber into a first internal chamber 130 and a second internal chamber 132 on opposite sides of piston 126. The first internal chamber 130 may be filled with a clean fluid 134 and the second internal chamber 132 may be exposed to annulus pressure via a port 136. This embodiment enables control over the pressure level acting on power piston 68 via pressure close line 72 to be set via pressure in the annulus. The pressure open line 74 may be routed to, for example, a pressure source at the surface.

Figure 10:
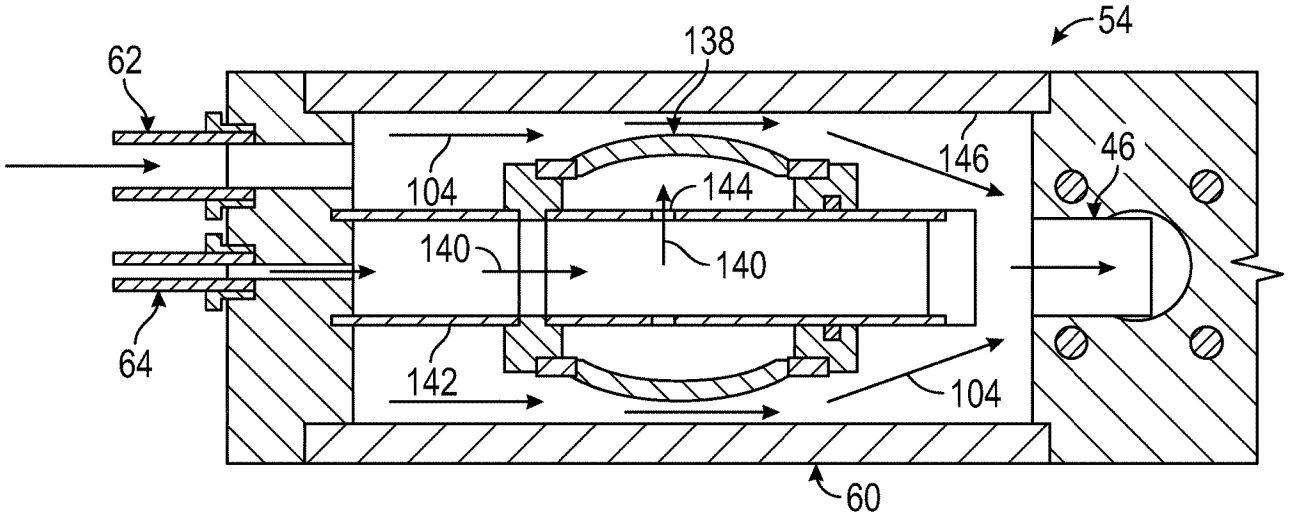
FIG. 10 is a schematic illustration of another example of a chemical injection valve, according to an embodiment of the disclosure.
Figure 11:
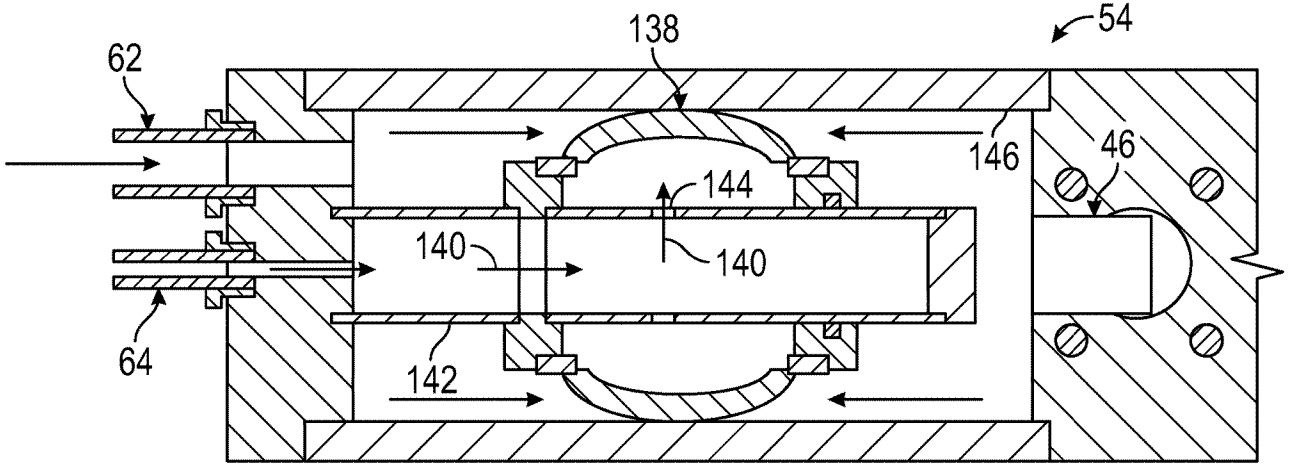
FIG. 11 is a schematic illustration similar to that of FIG. 10 but showing the chemical injection valve in a different operational position, according to an embodiment of the disclosure.
Figure 12:
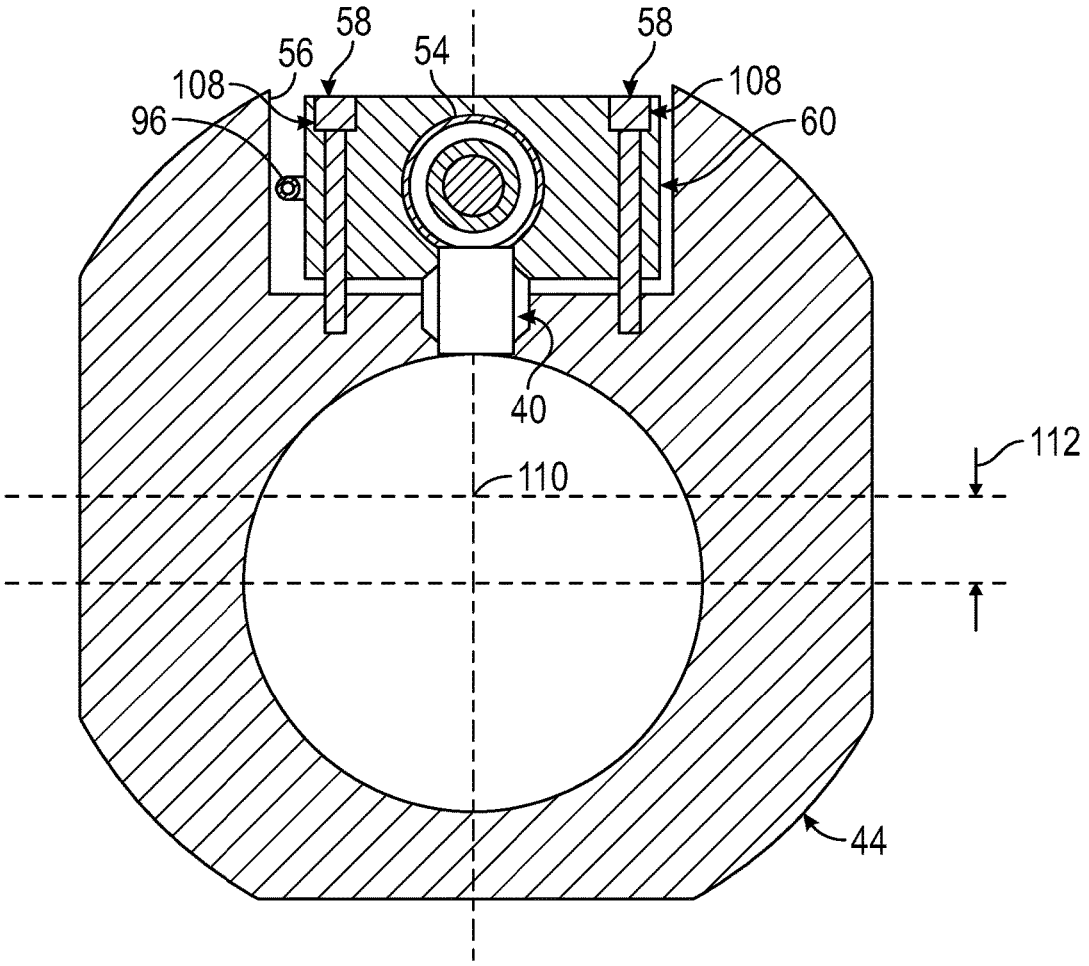
FIG. 12 is a cross-sectional view of the chemical injection valve illustrated in FIGS. 10 and 11 mounted in a chemical injection valve mandrel, according to an embodiment of the disclosure.

In FIGS. 10-12, another embodiment of chemical injection valve 54 is illustrated. In this example, actuation between the closed flow and open flow positions is controlled via an inflatable element 138 which may be inflated by hydraulic fluid supplied under pressure by at least one pressure control line 64. The pressurized hydraulic fluid, as represented by arrows 140, flows into a chamber structure 142 located within hydraulic block 60. The chamber structure 142, in turn, directs the pressurized hydraulic fluid into inflatable element 138 via a port 144.

Prior to inflating the inflatable element 138, the chemical injection fluid 104 readily flows from chemical injection inlet line 62, through hydraulic block 60, past the inflatable element 138, and out through chemical injection outlet line 46. Upon flow of pressurized hydraulic fluid 140 into the interior of inflatable element 138 from pressure control line 64, however, the inflatable element 138 is inflated outwardly. As the inflatable element 138 is further inflated, the element 138 is forced into sealing engagement with an interior surface 146 of hydraulic block 60. The sealing engagement prevents further flow of chemical injection fluid 104 through the chemical injection valve 54.

The outflow of chemical injection fluid 104 may be directed to a corresponding chemical injection mandrel 38 for injection through the at least one injection port 40. As illustrated in FIG. 12, however, the injection port 40 may be positioned in or proximate to hydraulic block 60 for direct injection into the internal flow passage 42. It should be noted that in this embodiment and other embodiments, the flow of chemical injection fluid 104 may be directed to other locations, e.g. locations external to flow passage 42.

Figure 13:
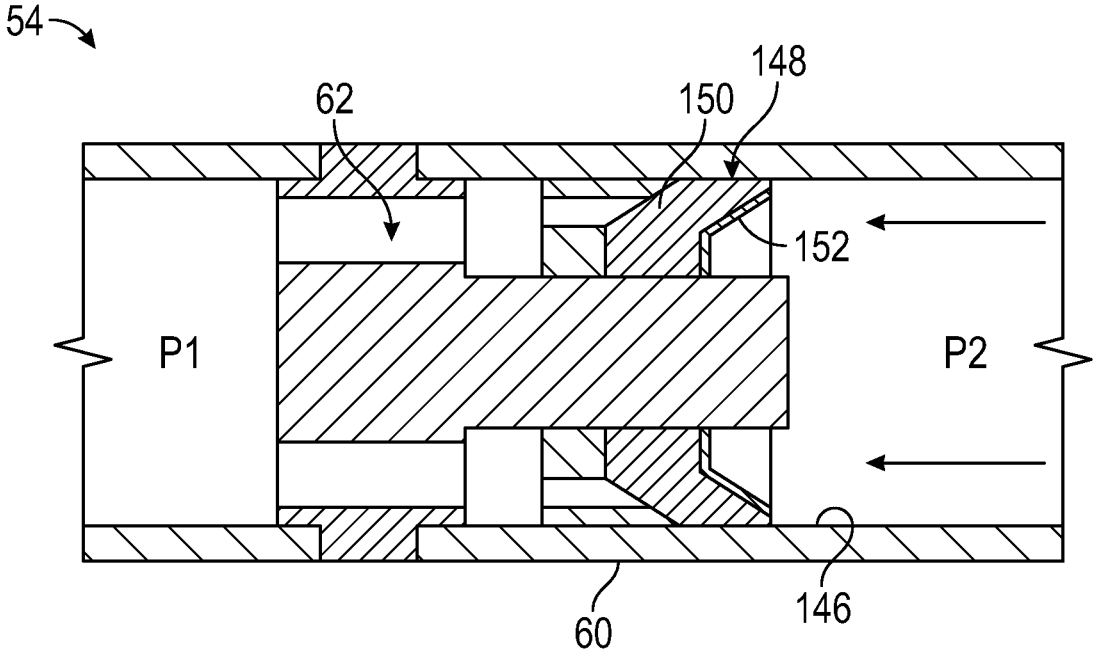
FIG. 13 is a schematic illustration of another example of a chemical injection valve, according to an embodiment of the disclosure.
Figure 14:
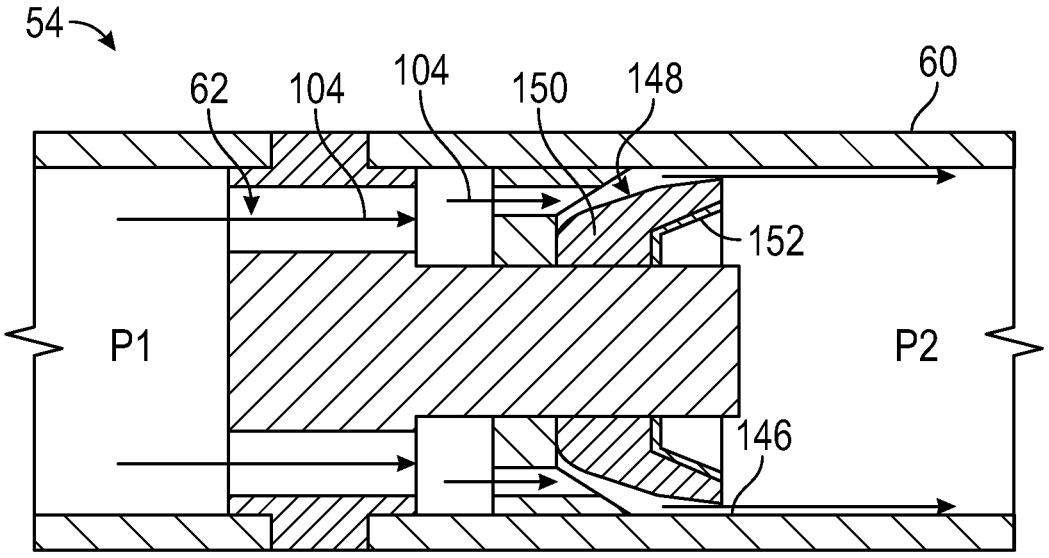
FIG. 14 is a schematic illustration similar to that of FIG. 13 but showing the chemical injection valve in a different operational position, according to an embodiment of the disclosure.

Referring generally to FIGS. 13 and 14, another embodiment of chemical injection valve 54 is illustrated. In this example, flow through the chemical injection valve 54 is controlled by a spring-loaded seal element 148. By way of example, the spring-loaded seal element 148 may comprise a seal cup 150 biased outwardly into sealing engagement with internal surface 146 via a spring, such as a plate spring 152. When sufficient pressure is applied to the chemical injection fluid in chemical injection inlet line 62, the spring-loaded seal element 148 is transitioned from a closed position, as illustrated in FIG. 13, to an open flow position, as illustrated in FIG. 14.

It should be noted chemical injection valve 54 may have other constructions selected for specific applications and/or environments. In some operations, for example, the chemical injection valve 54 may have a construction similar to a gas lift valve, such as a nitrogen charged, bellows-type, injection pressure operated gas lift valve. Similarly, the chemical injection valve mandrel 44 may have other constructions. For example, the chemical injection valve mandrel 44 may be constructed as a side pocket mandrel having a side pocket into which the chemical injection valve 54 may be removably positioned. Such a side pocket mandrel may have a cross-section which is round or oval and sized to accommodate receipt of the chemical injection valve 54.

Figure 15:
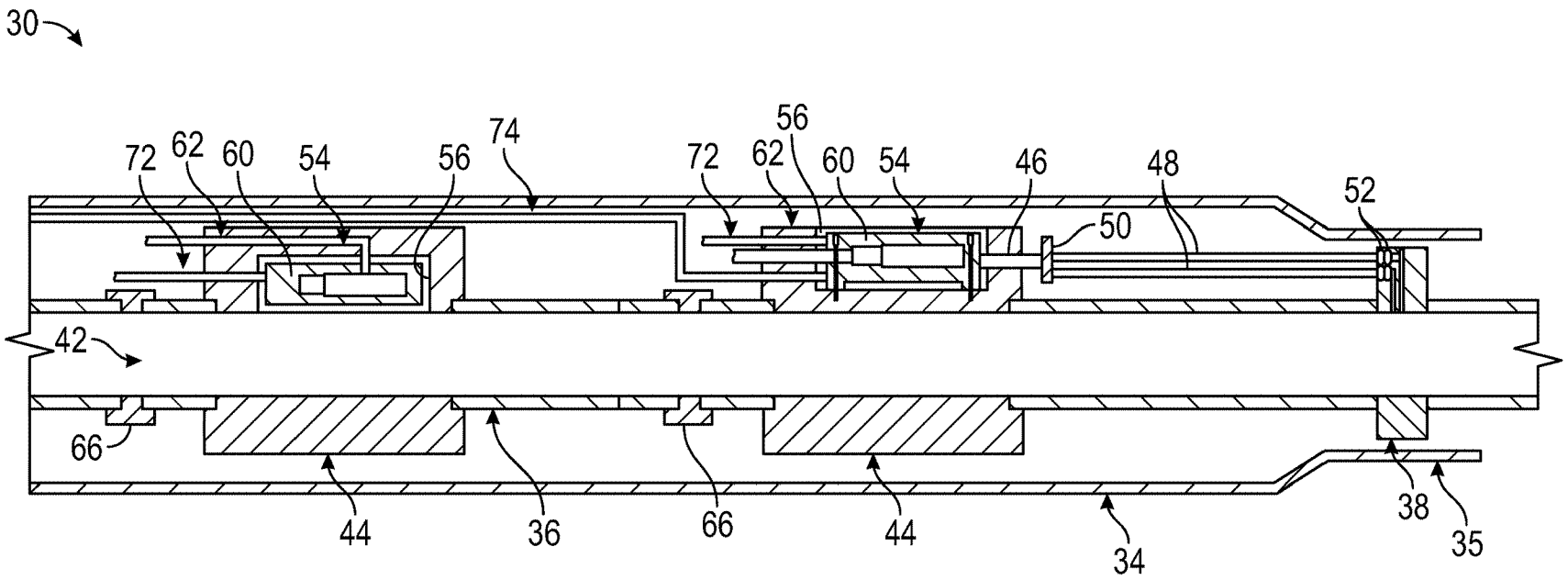
FIG. 15 is a schematic illustration of another example of a well system positioned in a borehole and comprising a plurality of chemical injection valves, according to an embodiment of the disclosure.

Referring generally to FIG. 15, another embodiment of well system 30 is illustrated. In this example, the well system 30 comprises a plurality of the chemical injection valve mandrels 44 and a plurality of the corresponding chemical injection valves 54. However, at least one of the chemical injection valve mandrels 44 (the left side chemical injection valve mandrel 44 in FIG. 15) is constructed so the corresponding chemical injection valve 54 is retrievable. As illustrated, the internal region 56 is open to internal flow passage 42 to enable placement and/or retrieval of the chemical injection valve 54 along the internal flow passage 42.

In some embodiments, the chemical injection valve mandrel 44 and retrievable chemical injection valve 54 may be constructed to enable injection of the chemical injection fluid directly into internal flow passage 42. The other chemical injection valve mandrel 44 and corresponding chemical injection valve 54 may be coupled with chemical injection mandrel 38, as with various embodiments described above.

According to the embodiment illustrated in FIG. 15 and according to other embodiments described herein, the chemical injection mandrel 38 may be separated from the corresponding chemical injection valve mandrel 44. However, the chemical injection mandrel 38 also may be integrated with or positioned proximate with the corresponding chemical injection valve mandrel 44. The parameters of a given operation and/or environment may affect the desired placement of the chemical injection mandrel 38 and the corresponding injection port or ports 40.

Depending on the parameters of a given application and/or environment, the structure of the overall well system 30 may be adjusted. Similarly, the structure and positioning of the chemical injection mandrel 38 and/or chemical injection valve mandrel 44 may be selected according to the specific application and/or environment. Various types of chemical injection valves 54 and chemical injection ports 40 also may be used to achieve a desired injection of chemicals within the tubing or at locations outside of internal flow passage 42.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well casing;

a well tubing disposed in the well casing;

a chemical injection mandrel having at least one chemical injection port, the chemical injection mandrel being mounted along the well tubing;

a chemical injection valve mandrel mounted along the well tubing, the chemical injection valve mandrel being coupled with the chemical injection mandrel via at least one chemical injection outlet line extending to the at least one chemical injection port; and a chemical injection valve mounted in the chemical injection valve mandrel to control flow of chemical injection fluid to the at least one chemical injection outlet line, the chemical injection valve having a power piston coupled with a seal member, the power piston being manipulated via pressure applied in pressure control lines to shift the seal member between closed and open flow positions with respect to a flow of the chemical injection fluid to the at least one chemical injection port, wherein the chemical injection valve comprises a pressure equalization line routed to opposite sides of the power piston.

2. The system as recited in claim 1, wherein the power piston is spring biased in a direction toward shifting the seal member to an open flow position.

3. The system as recited in claim 1, wherein the pressure control lines comprise a pressure close line and a pressure open line.

4. The system as recited in claim 3, wherein the chemical injection valve may be held in a closed position by maintaining sufficient pressure in the pressure close line.

5. The system as recited in claim 4, wherein a spring member and a chemical injection pressure may be used to shift the chemical injection valve to an open flow position.

6. The system as recited in claim 1, wherein the chemical injection valve comprises a choke to control the amount of chemical injection fluid delivered to the at least one chemical injection port.

7. The system as recited in claim 1, wherein the chemical injection valve comprises detents located to provide a desired level of resistance to movement of the seal member at selected seal member positions.

8. The system as recited in claim 1, wherein a plurality of check valves is placed in the chemical injection mandrel upstream of the at least one chemical injection port.

9. The system as recited in claim 3, wherein the pressure close line is coupled with an annulus pressure chamber disposed in an annulus between the well casing and the well tubing, and wherein pressure in the pressure close line is an annulus pressure within the annulus pressure chamber.

10. The system as recited in claim 1, further comprising an additional chemical injection valve mandrel mounted along the tubing and having an additional chemical injection valve.

11. A system, comprising:

a tubing disposed in a well, the tubing having an internal flow passage;

a chemical injection valve mounted along the tubing externally of the internal flow passage to control flow of a chemical injection fluid; and a chemical injection mandrel mounted along the tubing, the chemical injection mandrel having at least one chemical injection port through which the chemical injection fluid may be injected into the internal flow passage when the chemical injection valve is shifted from a closed flow position to an open flow position, wherein the chemical injection valve comprises a power piston coupled with a seal member, the power piston being manipulated via pressure applied in pressure control lines to selectively shift the seal member between the closed flow position and the open flow position, and wherein the chemical injection valve comprises detents located to provide a desired level of resistance to movement of the seal member at selected seal member positions.

12. A system, comprising:

a tubing disposed in a well, the tubing having an internal flow passage;

a chemical injection valve mounted along the tubing externally of the internal flow passage to control flow of a chemical injection fluid; and a chemical injection mandrel mounted along the tubing, the chemical injection mandrel having at least one chemical injection port through which the chemical injection fluid may be injected into the internal flow passage when the chemical injection valve is shifted from a closed flow position to an open flow position, wherein the chemical injection valve comprises an inflatable element which may be selectively inflated to control flow of the chemical injection fluid.

13. A method, comprising:

mounting a chemical injection valve along a well tubing externally of an internal flow passage of the well tubing;

operating the chemical injection valve via hydraulic pressure to actuate the chemical injection valve between a closed flow position and an open flow position; and using the chemical injection valve to control flow of a chemical injection fluid to the internal flow passage via at least one injection port, wherein operating comprises shifting a power piston coupled to a seal member, the power piston being shifted via pressure control lines which direct the hydraulic pressure to the power piston, and wherein the chemical injection valve comprises detents located to provide a desired level of resistance to movement of the seal member at selected seal member positions.

14. The method as recited in claim 13, further comprising a spring biasing the power piston toward the open flow position.

15. The method as recited in claim 13, further comprising locating the at least one injection port in a chemical injection mandrel positioned along the well tubing; and passing the chemical injection fluid through a check valve located in the chemical injection mandrel upstream of the at least one injection port.

* * * * *